US005485700A

United States Patent [19]

Van Vranken

[11] Patent Number: 5,485,700

[45] Date of Patent: Jan. 23, 1996

[54] TELESCOPIC FLAG AND CONE DEVICE

[76] Inventor: Brian M. Van Vranken, c/o A. Richards 2 Kirkner La., Watervilet, N.Y. 12189

[21] Appl. No.: 314,316

[22] Filed: Sep. 28, 1994

[51] Int. Cl.[6] ..... G09F 17/00; E04H 12/32

[52] U.S. Cl. ..... 52/40; 52/298; 52/111; 116/173; 116/63 C; 404/9; 248/519; 248/523; 248/529

[58] Field of Search ..... 116/173–175, 63 P, 116/63 C, 63 R; 40/610, 612, 598; 404/9, 11; 248/511, 523, 519, 528, 529; 52/40, 103, 111, 174, 298, 726.3

[56] References Cited

U.S. PATENT DOCUMENTS

| | | | |
|---|---|---|---|
| 1,765,245 | 6/1930 | Scott | 116/173 |
| 2,002,756 | 5/1935 | Segelhorst | 40/612 X |
| 2,263,138 | 11/1941 | Olson | 116/173 |
| 2,521,496 | 9/1950 | Worhun | 116/173 |
| 2,954,005 | 9/1960 | Cloffi et al. | 116/63 C |
| 3,119,370 | 1/1964 | Keats | 116/173 |
| 3,477,161 | 11/1969 | Drexler | 116/173 X |
| 3,782,322 | 1/1974 | Wilson | 40/598 X |
| 4,925,334 | 5/1990 | Beard | 404/9 |
| 5,269,251 | 12/1993 | Freeman | 116/63 C |
| 5,343,825 | 9/1994 | Gazecimeon et al. | 116/173 |

FOREIGN PATENT DOCUMENTS

| | | | |
|---|---|---|---|
| 0216329 | 12/1956 | Australia | 116/63 C |
| 2587050 | 3/1989 | France | 116/63 C |
| 3638697 | 6/1988 | Germany | 40/612 |

*Primary Examiner*—Carl D. Friedman
*Assistant Examiner*—Robert J. Canfield

[57] ABSTRACT

A new and improved telescopic flag and cone device with a cone portion having an open top and a closed bottom. A pole portion having a plurality of telescoping poles is received through the open top of the cone portion and secured to the closed bottom. An uppermost pole has a securement slot therein. A flag portion is received through the securement slot of the uppermost pole for securement therewith. The flag portion optionally wraps around the uppermost pole thereby permitting the plurality of poles to be telescopically received within the cone portion for storage purposes.

2 Claims, 4 Drawing Sheets

TELESCOPIC FLAG AND CONE DEVICE

BACKGROUND OF THE INVENTION

Field of the Invention

The present invention relates to a telescopic flag and cone device and more particularly pertains to providing clearly defined marker points for athletic drills with a telescopic flag and cone device.

Description of the Prior Art

The use of assorted cone devices is known in the prior art. More specifically, assorted cone devices heretofore devised and utilized for the purpose of marking an area are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,269,251 to Freeman discloses a traffic safety control system and method.

U.S. Pat. No. 5,219,171 to Kirby et al. discloses a collapsible golf fairway distance marker.

U.S. Pat. No. 5,090,349 to Wilson discloses a traffic safety cone.

U.S. Pat. No. Des. 266,653 to Cho discloses an extension for cone-shaped traffic marker.

U.S. Pat. No. 4,197,808 to Kinninger discloses a combined road marker and interchangeable sign cards.

While these devices fulfill their respective, particular objective and requirements, the aforementioned patents do not describe a telescopic flag and cone device for providing clearly defined marker points for athletic drills.

In this respect, the telescopic flag and cone device according to the present invention substantially departs from the conventional concepts and designs of the prior art, and in doing so provides an apparatus primarily developed for the purpose of providing clearly defined marker points for athletic drills.

Therefore, it can be appreciated that there exists a continuing need for new and improved telescopic flag and cone device which can be used for providing clearly defined marker points for athletic drills. In this regard, the present invention substantially fulfills this need.

SUMMARY OF THE INVENTION

In the view of the foregoing disadvantages inherent in the known types of assorted cone devices now present in the prior art, the present invention provides an improved telescopic flag and cone device. As such, the general purpose of the present invention, which will be described subsequently in greater detail, is to provide a new and improved telescopic flag and cone device and method which has all the advantages of the prior art and none of the disadvantages.

To attain this, the present invention essentially comprises a cone portion having an open top, a closed bottom, an inner surface, and an outer surface. An X shaped support structure is secured within the inner surface of the closed bottom. The X shaped structure functions as a stabilizer for the device. The device contains a pole portion having a first extent, a second extent, a third extent, and a fourth extent. The first extent is received through the open top of the cone portion and is secured to the X shaped support structure thereof. The second extent is telescopically coupled with the first extent. The third extent is telescopically coupled with the second extent. The fourth extent is telescopically coupled with the third extent. The fourth extent has a securement slot therein. The device contains a flag portion having a first end and a second end. The first end has a rigid member theresecured. The rigid member is received through the securement slot of the fourth extent of the pole portion for securement therewith. The second end optionally wraps around the fourth extent thereby permitting the fourth extent to be telescopically received within the third extent for storage purposes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved telescopic flag and cone device which has all the advantages of the prior art assorted cone devices and none of the disadvantages.

It is another object of the present invention to provide a new and improved telescopic flag and cone device which may be easily and efficiently manufactured and marketed.

It is a further object of the present invention to provide a new and improved telescopic flag and cone device which is of durable and reliable construction.

An even further object of the present invention is to provide a new and improved telescopic flag and cone device which is susceptible of a low cost of manufacture with regard to both materials and labor, and which accordingly is then susceptible of low prices of sale to the consuming public, thereby making such a telescopic flag and cone device economically available to the buying public.

Still yet another object of the present invention is to provide a new and improved telescopic flag and cone device which provides in the apparatuses and methods of the prior art some of the advantages thereof, while simultaneously overcoming some of the disadvantages normally associated therewith.

Even still another object of the present invention is to provide a new and improved telescopic flag and cone device for providing clearly defined marker points for athletic drills.

Lastly, it is an object of the present invention to provide a new and improved telescopic flag and cone device with a cone portion having an open top and a closed bottom. A pole portion having a plurality of telescoping poles is received through the open top of the cone portion and secured to the closed bottom. An uppermost pole has a securement slot therein. A flag portion is received through the securement slot of the uppermost pole for securement therewith. The flag portion optionally wraps around the uppermost pole thereby permitting the plurality of poles to be telescopically received within the cone portion for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
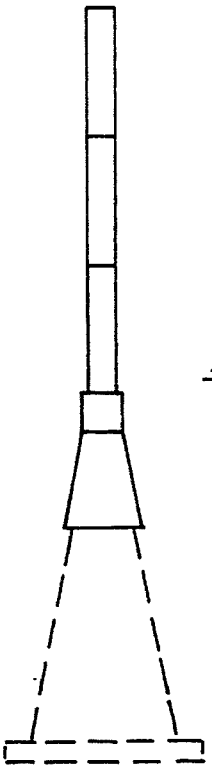
FIG 1 PRIOR ART
FIG. 1 is a side elevational view of the prior art extension for cone-shaped traffic marker.
Figure 2:
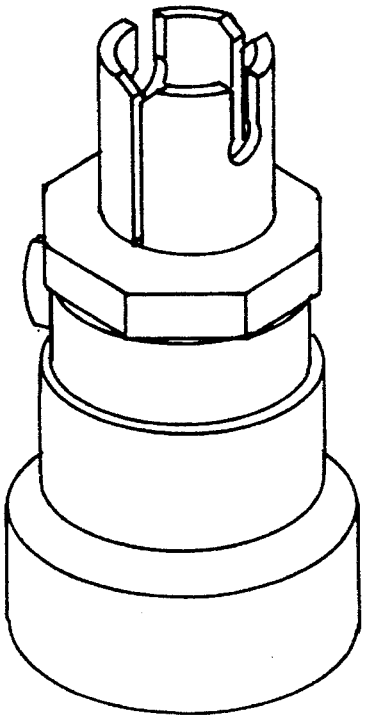
FIG 2 PRIOR ART
FIG. 2 is a view of one possible embodiment of the prior art traffic safety control system and method.
Figure 3:
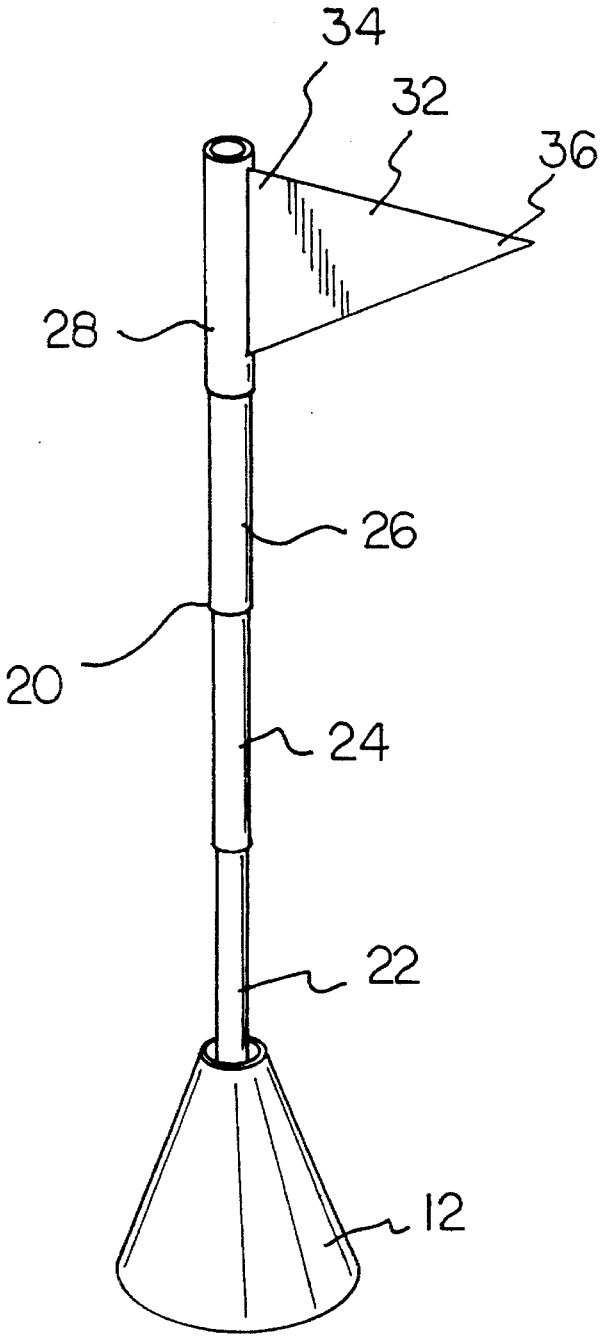
FIG. 3 is a front view of the present invention in the extended position.
Figure 4:
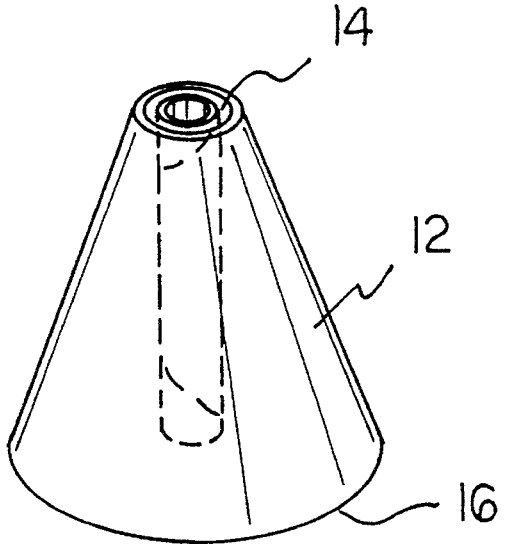
FIG. 4 is a front elevational view of the present invention in the collated position.
Figure 5:
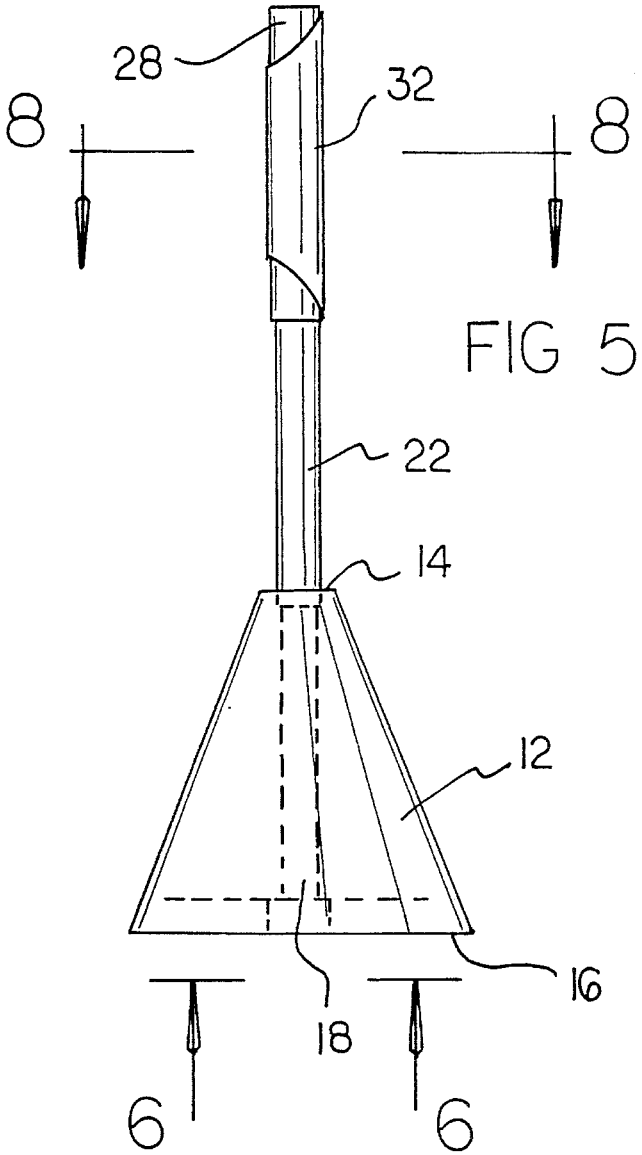
FIG. 5 is a front elevational view of the present invention in the wrapped position.
Figure 6:
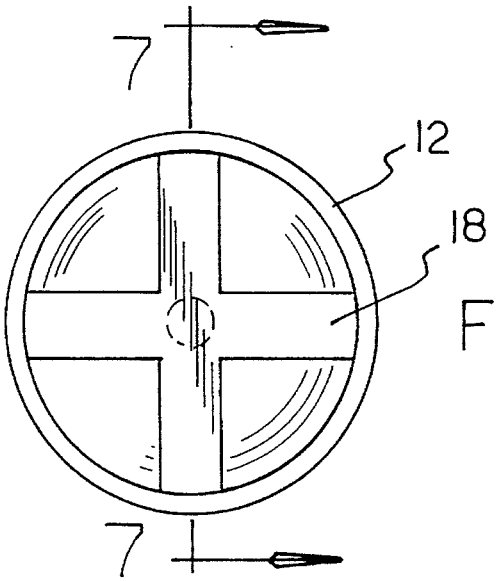
FIG. 6 is a cross-sectional view of the present invention taken along line 6—6 of FIG. 5.
Figure 7:
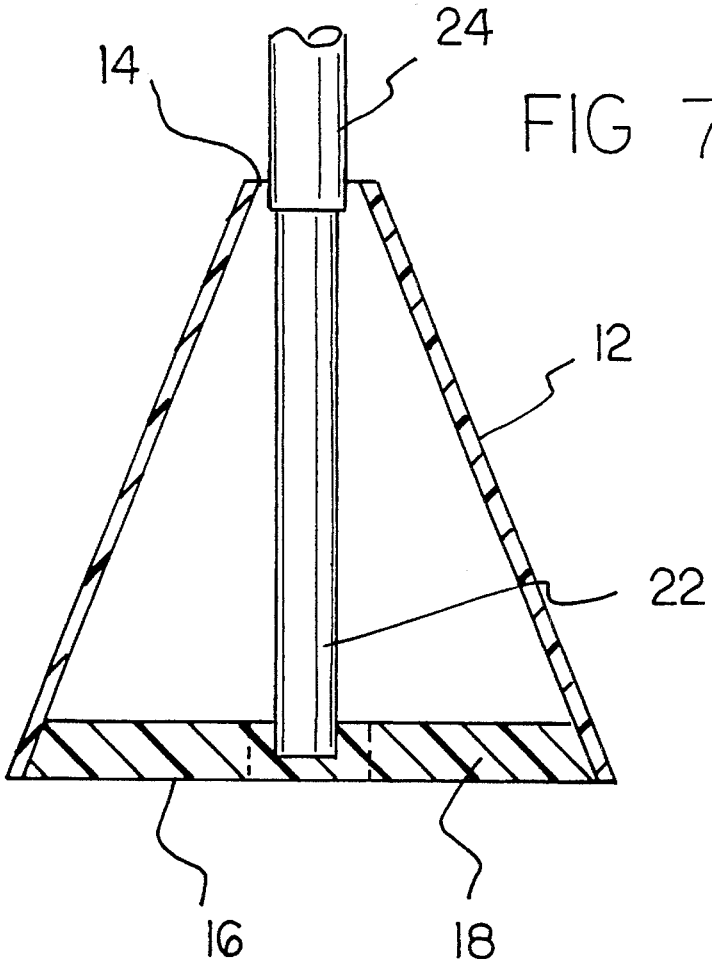
FIG. 7 is a cross-sectional view of the present invention taken along line 7—7 of FIG. 6.
Figure 8:
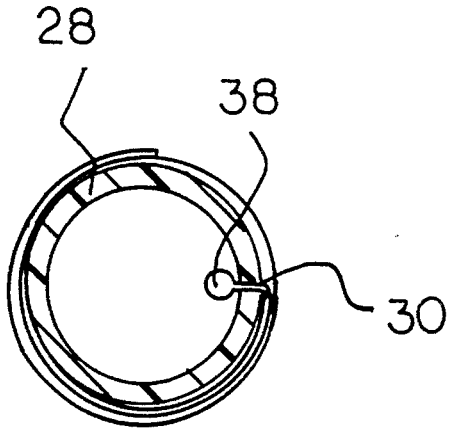
FIG. 8 is a cross-sectional view of the present invention taken along line 8—8 of FIG. 5.

With reference now to the drawings, and in particular, to FIG. 3 thereof, the preferred embodiment of the new and improved telescopic flag and cone device embodying the principles and concepts of the present invention will be described.

Specifically, it will be noted in the various Figures that the device relates to a new and improved telescopic flag and cone device for providing clearly defined marker points for athletic drills. In its broadest context, the device consists of a cone portion, a pole portion, and a flag portion.

The device contains a cone portion 12 having an open top 14, a closed bottom 16, an inner surface, and an outer surface. An X shaped support structure 18 is secured within the inner surface of the closed bottom 16. The X shaped structure 18 functions as a stabilizer for the device. The cone portion 12 represents the base portion for the device. The cone portion 12 can be manufactured in a variety of sizes and colors.

The device 10 contains a pole portion 20 having a first extent 22, a second extent 24, a third extent 26, and a fourth extent 28. The first extent 22 is received through the open top 14 of the cone portion 12 and is secured to the X shaped support structure 18 thereof. The second extent 24 telescopically requires the first extent 22 nested therein. The third extent 26 telescopically receives the second extent 24 nested therein. The fourth extent 28 telescopically receives the third extent 26 nested therein. The fourth extent 28 has a securement slot therein 30. The pole portion 20 extends out of the cone portion 12 to a preferred height of 4½ feet, but could be constructed in different sizes. When the device is not in use, the pole portion 20 can be completely collapsed within the cone portion 12.

The device contains a flag portion 32 having a first end 34 and a second end 36. The first end 34 has a rigid member 38 theresecured. The rigid member 38 is received through the securement slot 30 of the fourth extent 28 of the pole portion 20 for securement therewith. The second end 36 optionally wraps around the fourth extent 28 thereby permitting the fourth extent 28 to be telescopically received within the cone 12 for storage purposes.

The present invention is a flag 32, pole 20, and cone 12 assembly for use in training sports teams. It provides clearly defined marker points for athletic drills.

The product is made of plastic (except for the flag 32) and consists of three components: a cone-shaped base 12 (with the tip of the cone cut off), a telescoping flag pole 20, and the flag 32 itself, which is made of polyamide/nylon. The bottom end of the pole is attached to the bottom of the base, where there is an X-shaped structure 18. The base and flagpole 20 together reach a height of 4½ feet. The flag 32 has a triangular shape, with a base 5 inches high. From base to tip the flag 32 is 8 inches long.

The flag 32 wraps around the pole 20 so that both flag 32 and pole 20 can be collapsed into the cone 12 when not in use. When needed, simply extend the pole 20 from the cone 12 and unfurl the flag 32. For example: a soccer team can line up a number of these items in a row with a little spacing inbetween each one and dribble back and forth around the flags 32.

The advantage of this product over similar items, such as cones without flags—is that it is much harder for people to cheat by stepping over the cone 12 instead of going around it. Since the purpose of the flags 32 is to simulate opposing players, and since you cannot step over an opposing player, this product provides more realistic practice conditions. Its flag 32 and tall height make it highly visible.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved telescopic flag and cone device for providing clearly defined marker points for athletic drills comprising, in combination:

a cone portion having an open top, a closed bottom, an inner surface, and an outer surface, an X shaped support structure secured within the inner surface of the closed bottom, the X shaped structure functioning as a stabilizer for the device;

a pole portion having a first extent, a second extent, a third extent, and a fourth extent, the first extent received through the open top of the cone portion and secured to the X shaped support structure thereof, the second extent telescopically receiving the first extent nested therein, the third extent telescopically receiving the second extent nested therein, the fourth extent telescopically receiving the third extent nested therein, the fourth extent having a securement slot therein;

a flag portion having a first end and a second end, the first end having a rigid member theresecured, the rigid member received through the securement slot of the fourth extent of the pole portion for securement therewith, the second end optionally wrapping around the fourth extent permitting the fourth extent to be telescopically received within the cone for storage purposes.

2. A new and improved telescopic flag and cone device for providing clearly defined marker points for athletic drills comprising, in combination:

a cone portion having an open top and a closed bottom;

a pole portion having a plurality of telescoping poles received through the open top of the cone portion and secured to the closed bottom, an uppermost pole having a securement slot therein and telescopically receiving an adjacent pole nested therein;

a flag portion received through the securement slot of the uppermost pole for securement therewith, the flag portion optionally wrapping around the uppermost pole permitting the plurality of poles to be telescopically received within the cone portion for storage purposes further including the cone portion having an X shaped support structure secured within the closed bottom, the X shaped support structure functioning as a stabilizer.

* * * * *